United States Patent [19]

Halbach

[11] 3,992,599

[45] Nov. 16, 1976

[54] INTERLOCK FOR ARC CHUTE OF CIRCUIT MAKER AND BREAKER

[75] Inventor: Edward A. Halbach, Milwaukee, Wis.

[73] Assignee: Allis-Chalmers Corporation, Milwaukee, Wis.

[22] Filed: Apr. 21, 1975

[21] Appl. No.: 570,214

Related U.S. Application Data

[63] Continuation-in-part of Ser. No. 470,568, May 16, 1974, abandoned.

[52] U.S. Cl. ..... 200/144 R; 200/50 A

[51] Int. Cl.[2] ..... H01H 33/50

[58] Field of Search ..... 200/144 R, 50 A

[56] References Cited

UNITED STATES PATENTS

| | | | |
|---|---|---|---|
| 3,278,698 | 10/1966 | Metz | 200/50 A |
| 3,612,796 | 10/1971 | Doos | 200/144 R |
| 3,655,926 | 4/1972 | Meermans | 200/50 A |
| 3,728,506 | 4/1973 | Heehler et al. | 200/144 R |
| 3,772,489 | 11/1973 | Wilson | 200/144 R |

*Primary Examiner*—Robert S. Macon
*Attorney, Agent, or Firm*—Robert C. Sullivan

[57] ABSTRACT

A circuit maker and breaker has a removable arc chute for interrupting an arc formed between the movable and stationary contacts. A pivotally movable interlock device is mounted in a cavity in the insulating base of the circuit maker and breaker in the region where the contact-carrying armature is movable into engagement with a magnetic yoke to close the movable contact of the circuit maker and breaker into engagement with the stationary contact. The pivotally movable interlock device includes a plug-like member which is movable into the path of movement of the contact-carrying armature to prevent closure of the armature if the arc chute is not properly positioned on or is absent from the circuit maker and breaker. The interlock device is actuated by a lever which is engaged by a surface on the arc chute as the arc chute is slid into proper position on the circuit maker and breaker, to thereby move the interlock device out of plugging or blocking relation to the armature. In the absence of the arc chute, or in case of improper positioning of the arc chute, the interlock device will move about its pivotal axis to interpose the interlocking plug member into the path of closing movement of the contact-carrying armature to prevent closing of the armature and thus to prevent closing of the movable contact relative to the stationary contact. In one embodiment of the invention, when the arc chute is absent or improperly positioned the interlocking plug member moves due to the force of gravity into the path of closing movement of the contact-carrying armature; while in another embodiment of the invention when the arc chute is absent or improperly positioned the stored energy of a biasing spring moves the interlocking plug member into the path of closing movement of the contact-carrying armature. In the second embodiment, the force of the spring member may be, but is not necessarily, supplemented by the force of gravity in moving the plug member into the path of closing movement of the contact-carrying armature.

26 Claims, 7 Drawing Figures

INTERLOCK FOR ARC CHUTE OF CIRCUIT MAKER AND BREAKER

CROSS REFERENCE TO RELATED PATENT APPLICATION

This application is a continuation-in-part of my prior United States patent application Ser. No. 470,568, entitled "Interlock for Arc Chute of Circuit Maker and Breaker, " filed May 16, 1974, now abandoned, and assigned to the same assignee as the present application.

BACKGROUND OF THE INVENTION

Field of the Invention

This invention relates to circuit makers and breakers and in particular to high current capacity circuit makers and breakers having an arc-extinguishing chute to interrupt the current, and more particularly to a device of this type having an interlock arrangement to prevent closure of the electrical contacts of the circuit maker and breaker if the arc chute is improperly positioned or is entirely absent.

Circuit interrupters of high-current capacity such as direct current contactors usually have an arc-extinguishing chute which is removable to permit inspection, maintenance and repair of the contacts and/or of the arc chute. IF the circuit maker and breaker (or contactor) should attempt to open to interrupt the electrical circuit under overload conditions with the arc chute removed from or improperly assembled on the contactor, serious consequences could result, including serious damage to the contacts of the contactor.

It has been known in the prior art to provide interlock arrangements for preventing initial closure of the contactor if the arc chute associated with the contactor is improperly assembled on or is removed from the contactor. Examples of such prior art interlock arrangements are shown, for example, by the following U.S. Pat. Nos. 1,731,200 issued to George W. O'Keeffe on Oct. 8, 1929; 3,612,796 issued to Gustav W. Doos on Oct. 12, 1971; and 3,728,506 issued to Arthur C. Heehler et al on Apr. 17, 1973.

STATEMENT OF THE INVENTION

Accordingly, it is an object of the present invention to provide a circuit maker and breaker having a removable arc chute and an improved interlock to prevent closure of the circuit maker and breaker when the arc chute is improperly assembled on or is removed from or absent from the circuit maker and breaker.

In achievement of this objective, there is provided in accordance with embodiments of the invention, a circuit maker and breaker having a removable arc chute for interrupting an arc formed between the movable and stationary contacts. A pivotally movable interlock device is mounted in a cavity in the insulating base of the circuit maker and breaker in the region where the contact-carrying armature is movable into engagement with a magnetic yoke to close the movable contact of the circuit maker and breaker into engagement with the stationary contact. The pivotally movable interlock device includes a plug-like member which is movable into the path of movement of the contact-carrying armature to prevent closure of the armature if the arc chute is not properly positioned on or is absent from the circuit maker and breaker. The interlock device is actuated by a lever which is engaged by a surface on the arc chute as the arc chute is slid into proper position on the circuit maker and breaker, to move the interlock device out of plugging or blocking relation to the armature. In the absence of the arc chute, or in case of improper positioning of the arc chute, the interlock device will move about its pivotal axis to interpose the interlocking plug member into the path of closing movement of the contact-carrying armature to prevent closing of the armature and thus to prevent closing of the movable contact relative to the stationary contact. In one embodiment of the invention, when the arc chute is absent or improperly positioned, the interlocking plug member moves due to the force of gravity into the path of closing movement of the contact-carrying armature; while in another embodiment of the invention when the arc chute is absent or improperly positioned the stored energy of a biasing spring moves the interlocking plug member into the path of closing movement of the contact-carrying armature. In the second embodiment, the force of the spring member may be, but is not necessarily, supplemented by the force of gravity in moving the plug member into the path of closing movement of the contact-carrying armature.

Further objects and advantages of the invention will become apparent from the following description taken in conjunction with the accompanying drawings in which:

DESCRIPTION OF THE PREFERRED EMBODIMENTS

Figure 4:
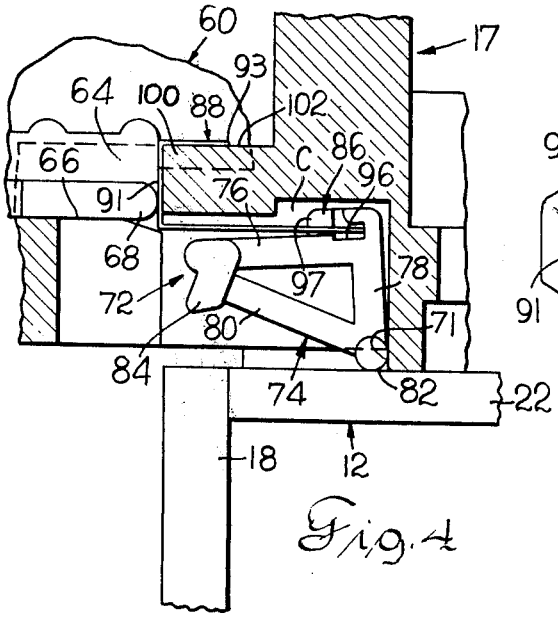
FIG. 4 is a view similar to FIG. 3 but showing the interlock device in the position which it occupies when the arc chute is properly assembled relative to the contactor housing.

Referring now to the drawings, there is shown a direct current contactor generally indicated at 10 comprising a U-shaped ferromagnetic frame generally indicated at 12 which embraces a cylindrical electrical operating coil 14 which is in surrounding relation to a ferromagnetic core 16 extending axially of coil 14. A ferromagnetic armature 18 is pivotally connected at its lower end relative to the view shown in FIG. 1 to the lower leg 20 of the U-shaped frame 12. When coil 14 is energized to close the contactor, ferromagnetic armature 18 is pulled up against the upper leg 22 of the ferromagnetic yoke or frame 12 as shown in the positions of FIGS. 1 and 4.

The various elements of the direct current contactor are mounted on a suitable base generally indicated at 17 of a suitable insulating material such as a suitable molded plastic.

It might be noted that the term "direct current contactor" is used in the art and also in the specification and claims of the present application to designate a direct current circuit maker and breaker.

Figure 1:
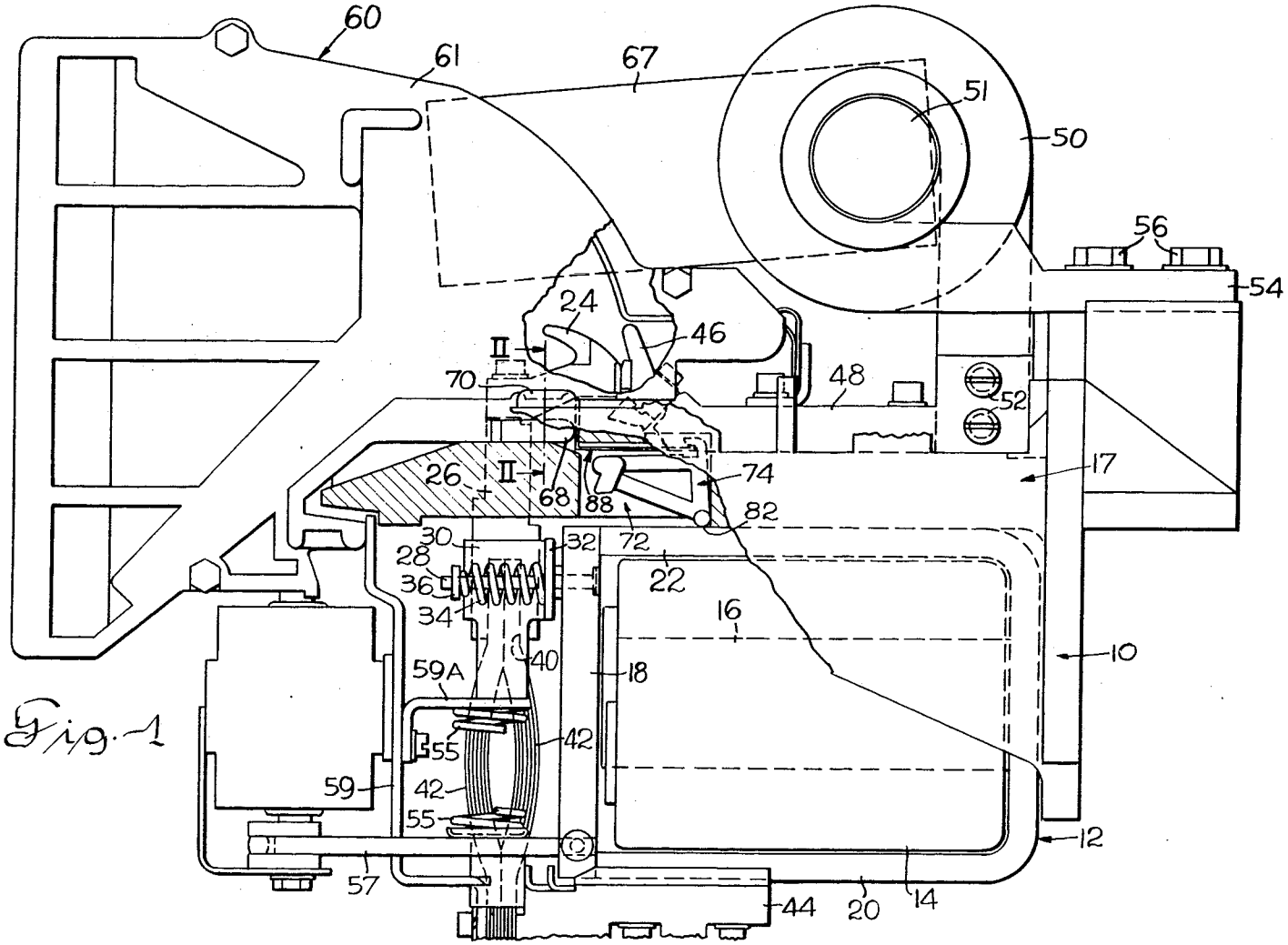
FIG. 1 is a view partially in vertical elevation and partially in vertical section of a one pole direct current circuit maker and breaker (or "contactor") provided with an arc chute and having an interlock in accordance with the invention.

The movable contact 24 of the circuit maker and breaker 10 is rigidly secured to the upper end relative to FIG. 1 of a rectangular cross section bus bar conductor 26 which is mounted on and movable with armature 18. Bus bar conductor 26 to which the movable contact 24 is connected is secured to the movable armature 18 by headed pin members 28, one of which is shown in FIG. 1. Headed pins 28 extend through clearance holes in armature 18 and in ears 32 of a clamping plate 30 which is secured to bus bar conductor 26. Springs 34 surround pins 28 and react between ears 32 of clamping plate 30 and snap rings 36 affixed to the ends of pins 28. Springs 34 surrounding pins 28 are compressed when the stationary and movable contacts 46 and 24 of the circuit maker and breaker engage when armature 18 is magnetically attracted to frame 12 upon energization of coil 14, and springs 34 provide most of the restoring force which returns armature 18 to its open position when magnetic coil 14 is deenergized.

One end of a pair of flexible conductors 42 which carry the load current which the circuit maker and breaker interrupts is crimped within an opening 40 at the lower end, relative to the view of FIG. 1, of bus bar conductor 26. The opposite or lower end of the flexible conductors 42 is suitably secured to terminal block 44 at the lower end of the insulating base of the circuit maker and breaker.

The stationary contact 46 with which the movable contact 24 cooperates is conductively secured to a stationary bus bar conductor 48 mounted on the insulating base 17 of the circuit maker and breaker. A magnetic blow-out coil 50 is mounted at the right-hand end of the insulating base 17 relative to the view of FIG. 1 and comprises a plurality of helical turns of heavy copper strap surrounding a ferromagnetic core 51. The copper strap at one end of the blow-out coil 50 is connected to bus bar conductor 48 by screws 52, and the opposite end of the copper strap constituting the blow-out coil 50 terminates in a connector plate 54 having terminal means 56 adapted for connection to a conductor from an electrical load.

Ferromagnetic flux-carrying pole pieces 67 abut against the ends of magnetic core 51 of blow-out coil 50 and extend radially beyond the blow-out coil turns and are adapted to engage ferromagnetic pole piece plates of arc chute 60, as explained in U.S. Pat. No. 3,511,950 to Donald R. Boyd.

Armature restoring springs 55 (one of which is seen in FIG. 1) have one end seated on a U-shaped lever arm 57 which is secured to armature 18 contiguous the lower end of armature 18 in a plane substantially perpendicular to the plane of armature 18. Lever arm 57 is movable with armature 18. The upper end of springs 55 abut against the protruding ears 59A of a support bracket 59 which is stationary relative to contactor base 17. Restoring springs 55 are compressed when armature 18 is attracted to magnetic yoke 12 and urge armature 18 to its open position wherein the stationary and movable contacts are separated. Thus, when magnetic coil 14 is deenergized, springs 55 are effective to assist springs 34 to move armature 18, and consequently movable contact 24, to open position.

It can be seen that when the direct current contractor is in closed position as seen in the view of FIG. 1, a circuit is established from connector plate 54 to blow-out coil 50, through blow-out coil 50 to bus bar 48, through stationary contact 46 to movable contact 24 which is closed position, to bus bar conductor 26 secured to movable contact 24 and carried by armature 18, through flexible conductors 42 and thence to terminal block 44. The circuit just described is interrupted when magnetic coil 14 is deenergized to permit springs 34 and 55 to move armature 18 out of engagement with magnetic yoke 12 (the position of the armature 18 shown in FIG. 3 of the drawings).

Figure 2:
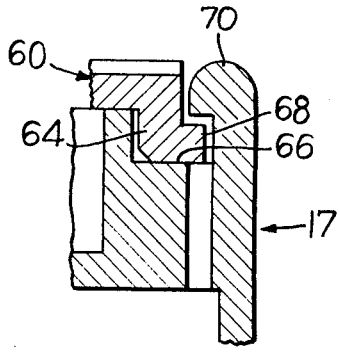
FIG. 2 is a view in vertical section along line II—II of FIG. 1 to show the slidable engagement of the arc chute with one of the guide tracks on the insulating base of the contactor.

An arc chute generally indicated at 60 is provided and is slidably engaged with the insulating base 17 as best seen in FIGS. 1 and 2 of the drawings in accordance with which the laterally opposite side walls of the arc chute are each provided at the lower ends thereof with a downwardly depending flange 64 which engages a channel-shaped guide track 66 formed in the molded plastic insulating base 17 of the circuit maker and breaker contiguous the lateral outer sides of base 17. The downwardly depending flange 64 of the arc chute 60 has molded integrally therewith a laterally extending ear 68 along a short portion of the length of the flange 64 and at the innermost end of flange 64, and this ear 68 is adapted to underlie a molded lug 70 carried by the side wall of the insulating base 17 of the circuit maker and breaker to prevent upward movement of arc chute 60 from its slidably engaged position relative to insulating base 17.

Arc chute 60 may be of the type disclosed in U.S. Pat. No. 3,511,950 issued to Donald R. Boyd and comprises a pair of laterally spaced side members one of which is shown in FIG. 1, and reference is made to that patent for details of the specific construction and operation of the arc chute and also for more specific details of the construction of the direct current contactor. The side members 61 of arc chute 60 are preferably molded of a gas evolving insulating material and may be of a phosphoric acid-bonded asbestos material. The side members 61 define an arcing compartment which embraces the stationary contact 46 and the movable contact 24 when the arc chute is properly assembled on the circuit maker and breaker structure as shown in the positions of FIGS. 1 and 4.

Reference is also made to U.S. Pat. No. 3,612,796 to Gustav W. Doos for more specific details of the direct current contactor, although the arc chute interlock shown by the Doos patent is different than that of the present application.

DESCRITPTION OF MECHANICAL INTERLOCK FOR ARC CHUTE

Positioned in a cavity C provided at one lateral side of the molded plastic base 17 of contactor 10 and in the region where armature 18 engages leg 22 of magnetic yoke 12, there is provided a mechanical interlock subassembly generally indicated at 72. Interlock subassembly 72 comprises a pivotally movable interlock member generally indicated at 74 which is approximately although not exactly in the shape of a right triangle and which includes walls 76 and 78 which are substantially at right angles to each other and a wall 80 which approximates the hypotenuse of the right-triangle-shaped interlock member. Interlock member 74 is formed of a suitable insulating material, preferably a molded plastic. At the junction of the two walls 78 and 80 there is provided a rounded edge 82 which serves as a pivot or fulcrum for the interlock member 72 and which rests on the upper surface of leg 22 of magnetic yoke 12. Rounded edge 82 of the interlock member 74 also bears against the bounding wall surface 71 of cavity C. No bearing sockets or the like are provided for rounded edge 82, the edge 82 merely pivoting on the upper surface of magnetic yoke leg 22.

Figure 3:
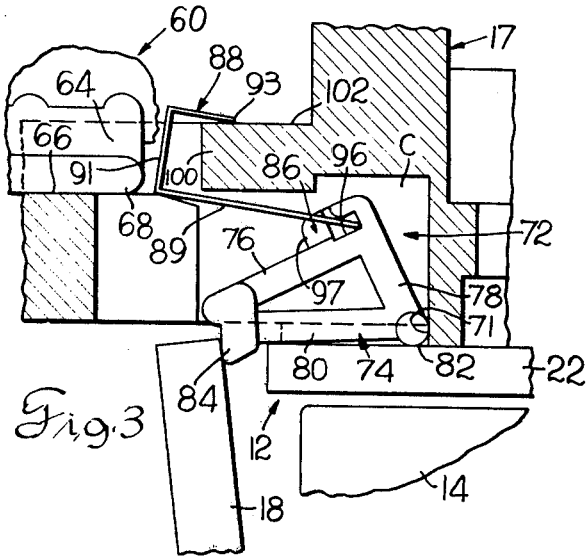
FIG. 3 is a fragmentary view partially in vertical elevation and partially in vertical section showing the position of the interlock device when the arc chute is improperly positioned, with the interlock device preventing closure of the contactor armature.
Figure 5:
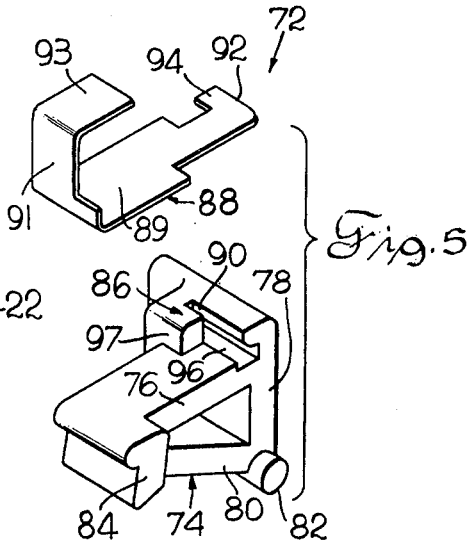
FIG. 5 is an exploded view of the interlock device.

At the junction of the walls 76 and 80, which is the apex of the right-triangle-shaped interlock member 74, there is provided a downwardly depending lug-like or plug-like member 84 which serves as the interlock element of the device. At the junction of the walls 76 and 78 of interlock member 74 there is provided a receptacle generally indicated at 86 for receiving the free end of the operating lever generally indicated at 88. Lever 88 may be formed of a spring-like metal. The receptacle 86 is provided with a slot 90 into which the end edge 92 of lever 88 may be inserted, with the tab or tongue portion 94 contiguous the innermost edge 92 of the lever then being receivable in and pivotably movable in recess 96 of receptacle 86 of interlock member 74. Recess 96 is bounded by the lug-like molded portion 97 which extends for only part of the lateral width of wall 76 of interlock member 74 and serves to retain tab 94 in recess 96. Recess 96 in effect serves as a bearing which accommodates the pivotal movement of lever 88 relative to interlock member 74 in moving between the FIG. 3 and FIG. 4 positions. As best seen in the views of FIGS. 3, 4 and 5, lever member 88 which engages interlock member 74 is provided at its outer or left-hand end relative to the views in the drawings with a U-shaped portion defined by the edge 91 which is perpendicular to the plane of main body portion 89 of the lever and by an inwardly bent or reversely bent portion 93 which extends at right angles to lever portion 91 and parallel to main body portion 89 of the lever. As best seen in the views of FIGS. 1, 3 and 4 the vertical portion 91 of lever 88 lies in the path of movement of one of the oppositely disposed flanges 64 of arc chute 60 and of ear 68 (FIG. 2) which extends laterally from flange 64. The interlock device shown and described herein is provided contiguous only one of the two opposite lateral sides of the base 17. Flange 64, as previously explained, engages guide track 66 formed in insulating base 17 of the circuit maker and breaker or direct current contactor whereby to permit relative sliding movement into position of arc chute 60 relative to base 17 of the direct current contactor.

When arc chute 60 is properly positioned relative to base 17 of the circuit maker and breaker 10 and thus relative to contacts 24 and 46, flange 64 and ear 68 of the arc chute are in the position shown in FIG. 4 of the drawings in which they have pushed the U-shaped end portion of lever 88 into sleeve-like or telescopic engagement with wall portion 100 of the circuit maker and breaker base 17. Wall portion 100 lies contiguous and above cavity C. When lever 88 thus engages wall portion 100 as seen in the view of FIG. 4, lever 88 holds the pivotally mounted interlock member 74 against the force of gravity about its pivotal axis 82 to the position shown in FIGS. 1 and 4 in which the plug or nose portion 84 of the interlock is raised above the level of armature 18 and of leg 22 of yoke 12 which armature 18 engages. Thus, when arc chute 60 is fully pushed into proper position as seen in the views of FIGS. 1 and 4, armature 18 can close into engagement with yoke leg 22 to thereby move movable contact 24 into engagement with fixed contact 46.

However, if the arc chute is not pushed into a position in which flange 64 of the arc chute is in the FIG. 4 position but instead the flange 64 and ear 68 is in the partially assembled position shown in FIG. 3 or perhaps in which the arc chute is entirely removed from the base 17 of the circuit maker and breaker or contactor, then the force of gravity acting upon interlock member 74 will cause the interlock member to drop downwardly with a counterclockwise motion about pivotal axis 82 relative to the views in the drawings to the position shown in FIG. 3 in which the plug or nose portion 84 of the interlock member 74 is interposed in the path of movement of armature 18 so that armature 18 cannot close into engagement with yoke 12; and in this FIG. 3 position, of course, movable contact 24 cannot move into engagement with the fixed contact 46. When interlock member 74 drops by gravity to the position shown in FIG. 3, it causes the U-shaped end portion of lever 88 to move to the position shown in FIG. 3 in which the U-shaped end portion does not fully engage wall portion 100 of the circuit maker and breaker base 17; although in this position (FIG. 3) upper leg 93 of lever 88 partially bears against the upper surface 102 of wall portion 100.

DESCRIPTION OF MODIFIED EMBODIMENT OF FIGS. 6 AND 7.

Figure 6:
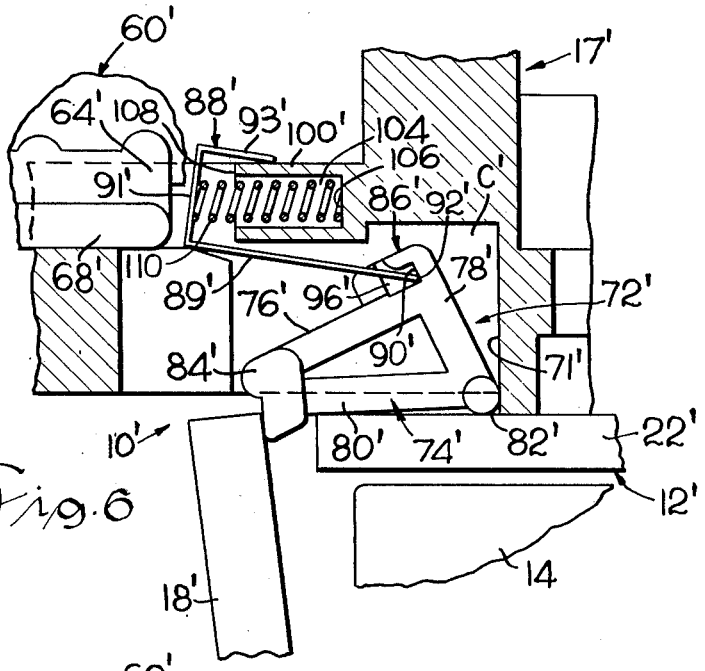
FIG. 6 is a fragmentary view in vertical elevation and partially in vertical section showing a modified arrangement in which the interlock device cooperates with a biasing spring, with the interlock device being shown in the position which it occupies when the arc chute is improperly assembled or positioned relative to the contactor housing with the interlock device preventing closure of the contactor armature.
Figure 7:
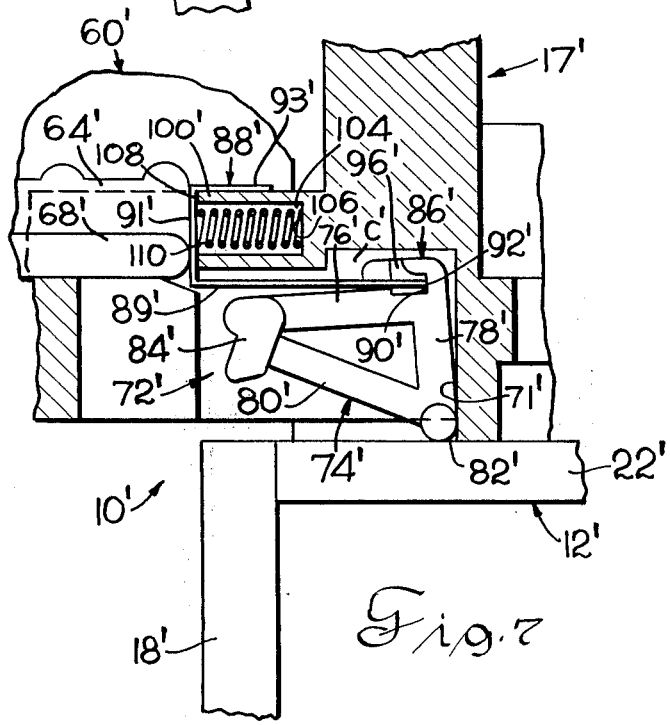
FIG. 7 is a view similar to FIG. 6 showing the use of the modified interlock arrangement using the biasing spring, and with the interlock device being shown in the position which it occupies when the arc chute is properly assembled relative to the contractor housing.

Referring now to FIGS. 6 and 7, there is shown a modified interlock arrangement which is generally similar to that previously described in connection with the embodiment of FIGS. 1–5, inclusive, but, additionally employs a spring means to ensure positive movement of the interlock member to its blocking position when the arc chute is not properly assembled on or is absent from the circuit maker and breaker.

The various parts shown in the embodiment of FIGS. 6 and 7 are similar to those previously described, with the exception of the addition of the spring means and the modification of the molded plastic base structure to receive the spring means with the interlock means. Therefore, parts of the structure of FIGS. 6 and 7 which correspond to the previously described embodiment will be given the same reference numerals but such reference numerals will be primed in the modified embodiment of FIGS. 6 and 7.

Referring now to FIGS. 6 and 7, there is shown an interlock subassembly generally indicated at 72′ which is positioned in a cavity C′ provided at one lateral side of the molded plastic base 17′ of a contactor 10′, and in the region where armature 18′ engages leg 22′ of a magnetic yoke 12', as previously described in the embodiment of FIGS. 1–5, inclusive. Interlock subassembly 72' comprises a pivotally movable interlock member generally indicated at 74' which is similar to the interlock member 74 previously described. The interlock member generally indicated at 74' includes walls 76' and 78', which are substantially at right angles to each other, and a wall 80' which approximates the hypotenuse of the right-triangle-shaped interlock member 74'. Interlock member 74' is formed of a suitable insulating material, preferably a molded plastic. At the junction of the two walls, 78' and 80', there is provided a rounded edge, 82', which serves as a pivot or fulcrum for the interlock member 72', and which rests on the upper surface of leg 22' of magnetic yoke 12'. Rounded edge 82' of interlock member also bears against the bounding wall surface 71' of cavity C'.

At the junction of the walls 76' and 80', which is the apex of the right-triangle-shaped interlock member 74', there is provided a downwardly-depending lug-like or plug-like member 84' which serves as the interlock element of the device, as in the peviously described embodiment. At the junction of the walls 76' and 78' of interlock member 74', interlock member 74' is provided with a receptacle generally indicated at 86' receiving the free end of the operating lever generally indicated at 88'. Receptacle 86' is constructed similarly to the receptacle 86 described in connection with the embodiment of FIGS. 1–5, inclusive, and cooperates with lever 88' in the same manner as previously described in connection with receptacle 86 and lever 88 of the embodiment of FIGS. 1–5, inclusive. The lever generally indicated at 88' is similar in construction to the lever 88 of the previous embodiment and includes the end edge 92' which is pivotally receivable in the slot 90' and recess 96' of receptacle 86' provided on interlock member 74', all in the same manner as previously described. Lever 88', as in the previously described embodiment, is provided at its outer or left-hand end relative to the views in FIGS. 6 and 7, with a U-shaped portion defined by th edge 91' which is prependicular to the plane of main body portion 89' of the lever, and by an inwardly bent or reversely bent portion 93' which extends at right angles to lever portion 91' and parallel to main body portion 89' of the lever.

In accordance with the modified form of the invention shown in FIGS. 6 and 7, the wall portion 100' of the circuit maker and breaker base 17', and which lies contiguous and above cavity C', is provided with a cavity 104 which is closed at its inner or right-hand end wall 106, as viewed in FIGS. 6 and 7, but which cavity 104 is open at its outer or left-hand end 108, as viewed in FIGS. 6 and 7. A coil spring 110 is adapted to be received in cavity 104. Spring 110 has a natural uncompressed length which is greater than the length of cavity 104 from end opening 108 to end wall 106 of cavity 104.

When arc chute 60' is properly positioned on base 17' of the circuut maker and breaker and is thus properly positioned relative to contacts 24 and 46 (FIG. 1), as shown in FIG. 7, flange 64' and ear 68' of the arc chute 60' are in the position in which they have pushed the U-shaped end portion of lever 88' into sleeve-like or telescopic engagement with wall portion 100'. When lever 88' is thus telescopically engaged with wall portion 100', lever 88' holds the pivotally mounted interlock member 74' about its pivotal axis 82' in the position shown in FIG. 7 in the same manner as previously described in connection with FIGS. 1 and 4, in which plug or nose portion 84' of interlock member 74 is raised above the level of armature 18' and of leg 22' of yoke 12' which armature 18' engages. Additionally, the engagement of flange 64' and ear 68' of the arc chute 60' with lever 88', as shown in the view of FIG. 7, causes end wall 91' of lever 88' to compress coil spring 110 to the position shown in FIG. 7 in which coil spring 110 is received entirely within cavity 104 of wall portion 100'. In this compressed position of coil spring 110, the coil spring 110 has energy stored therein which is tending to move lever 88' to the position of FIG. 6, but is prevented from doing so due to the engagement of flange 64' and ear 68' of arc chute 60' with lever 88' as previously explained.

However, if arc chute 60' is not pushed into a position in which flange 64' and ear 68' of the arc chute are in the FIG. 7 position, but instead flange 64' and ear 68' are in the partially assembled position of the arc chute shown in FIG. 6, or perhaps a situation prevails in which the arc chute is entirely removed from the base 17' of the circuit maker and breaker or contactor, then the stored energy of spring 110 will cause the compressed spring 110 to expand to its normal uncompressed length, as seen in the view of FIG. 6, moving lever 88' to the position of FIG. 6 in which it no longer engages wall portion 100' in the telescopic manner of FIG. 7. The motion transmitted to lever 88' by the expansion of spring 110 will effect a positive movement of interlock member 74' from its FIG. 7 position to its FIG. 6 position due to the fact that there is a positive pivotal connection between lever 88' and interlock member 74', due to the engagement of tab portion 94 (FIG. 5) of lever 88' with recess 96' of interlock member 78', as explained in connection with the previously described embodiment of FIGS. 1–4, inclusive. The movement of interlock member 74' from its FIG. 7 position to its FIG. 6 position will cause plug portion 84' to be interposed into the path of movement of armature 18' so that armature 18' cannot close into engagement with yoke 12', in the same manner as described in connection with the embodiment of FIGS. 1–5, inclusive.

It will be seen that in the particular embodiment illustrated in FIGS. 6 and 7, interlock member 74' moves from its FIG. 7 position to its FIG. 6 position due to the action of spring 110, with the force of gravity also aiding in the movement of interlock member 74' from its FIG. 7 to its FIG. 6 position.

From the foregoing detailed description fo the invention, it has been shown how the objects of the invention have been obtained in a preferred manner. However, modifications and equivalents of the disclosed concepts such as readily occur to those skilled in the art are intended to be included within the scope of this invention.

The embodiments of the invention in which an exclusive property or privilege is claimed are defined as follows:

1. In combination, a circuit maker and breaker including a stationary contact and a movable contact movable into engagement with said stationary contact, an arc chute adapted to be positioned on said circuit maker and breaker and defining an arcing compartment which embraces said stationary contact and said movable contact, an interlock means comprising an interlock member mounted for pivotal movement on said circuit maker and breaker, said interlock member including a plug element carried thereby, said interlock means additionally comprising a lever member engaging said interlock member and located in the path of positioning movement of said arc chute, whereby when said arc chute is properly positioned on said circuit maker and breaker means movable with said arc chute engages said lever member to pivotally move said interlock member to a position in which said plug element is moved out of blocking relation to movement of said movable contact into engagement with said stationary contact, said plug element moving into said blocking relation when said arc chute is improperly positioned on or is entirely absent from said circuit maker and breaker.

2. The combination defined in claim 1 in which when said arc chute is properly positioned on said circuit maker and breaker said means movable with said arc chute engages said lever member to pivotally move said interlock member to a position in which said plug element is moved against the force of gravity out of blocking relation to movement of said movable contact into engagement with said stationary contact, said plug element moving by the force of gravity into said blocking relation when said arc chute is improperly positioned on or is entirely absent from said circuit maker and breaker.

3. The combination defined in claim 1 in which said interlock means comprises a biasing spring which normally urges said interlock member to a position in which said plug member is in blocking relation to movement of said movable contact into engagement with said stationary contact, said means movable with said arc chute acting to render said biasing spring ineffective to move said plug member into said blocking relation when said arc chute is properly positioned on said circuit maker and breaker.

4. The combination defined in claim 3 in which said interlock member is additionally urged by the force of gravity to a position in which said plug member is in said blocking relation, said force of gravity being rendered ineffective to move said plug member into said blocking relation when said arc chute is properly positioned on said circuit maker and breaker.

5. The combination defined in claim 1 in which said circuit maker and breaker includes a ferromagnetic yoke, an electrical winding operatively associated with said yoke whereby said yoke is magnetized when said winding is energized, a ferromagnetic armature member mounted for movement into engagement with said yoke when said yoke is magnetized, said movable contact being carried by said armature member, said plug element of said interlock member moving into blocking relation to movement of said armature member into engagement with said yoke member when said arc chute is improperly positioned on or is entirely absent from said circuit maker and breaker, whereby to prevent closing movement of said movable contact into engagement with said fixed contact.

6. The combination defined in claim 1 in which said means movable with said arc chute which engages said lever member is a part of said arc chute.

7. The combination defined in claim 1 in which said lever member is pivotally connected contiguous one end thereof to said interlock member.

8. The combination defined in claim 7 in which said lever member includes a U-shaped end portion opposite said one end, said U-shaped end portion being telescopically engageable with a wall portion of the insulating base of said circuit maker and breaker.

9. An interlock means for use with a circuit maker and breaker, in which said circuit maker and breaker includes a stationary contact and a movable contact movable into engagement with said stationary contact, and in which an arc chute is adapted to be positioned on said circuit maker and breaker and defines an arcing compartment which embraces said stationary contact and said movable contact, said interlock means comprising an interlock member mounted for pivotal movement on said circuit maker and breaker, said interlock member including a plug element carried thereby, said interlock means additionally comprising a lever member engaging said interlock member and located in the path of positioning movement of said arc chute, whereby when said arc chute is properly positioned on said circuit maker and breaker means movable with said arc chute engages said lever member to pivotally move said interlock member to a position in which said plug element is not in blocking relation to movement of said movable contact into engagement with said stationary contact, said plug element moving into said blocking relation when said arc chute is improperly positioned on or is entirely absent from said circuit maker and breaker.

10. An interlock means for use with a circuit maker and breaker as defined in claim 9 in which when said arc chute is properly positioned on said circuit maker and breaker, said means movable with said arc chute engages said lever member to pivotally move said interlock member to a position in which said plug element is moved against the force of gravity out of blocking relation to movement of said movable contact into engagement with said stationary contact, said plug element moving by the force of gravity into said blocking relation when said arc chute is improperly positioned on or is entirely absent from said circuit maker and breaker.

11. An interlock means for use with a circuit maker and breaker as defined in claim 9 in which said interlock means comprises a biasing spring which normally urges said interlock member to a position in which said plug member is in blocking relation to movement of said movable contact into engagement with said stationary contact, said means movable with said arc chute acting to render said biasing spring ineffective to move said plug member into said blocking relation when said arc chute is properly positioned on said circuit maker and breaker.

12. An interlock means as defined in claim 11 in which said interlock member is additionally urged by the force of gravity to a position in which said plug member is in said blocking relation, said force of gravity being rendered ineffective to move said plug member into said blocking relation when said arc chute is properly positioned on said circuit maker and breaker.

13. An interlock means as defined in claim 9 in which said circuit maker and breaker includes a ferromagnetic yoke, an electrical winding operatively associated with said yoke whereby said yoke is magnetized when said winding is energized, a ferromagnetic armature member mounted for movement into engagement with said yoke when said yoke is magnetized, said movable contact being carried by said armature member, said plug element of said interlock member moving into blocking relation to movement of said armature member into engagement with said yoke member when said arc chute is improperly positioned on or is entirely absent from said circuit maker and breaker whereby to prevent closing movement of said movable contact into engagement with said fixed contact.

14. An interlock means as defined in claim 9 in which said means movable with said arc chute which engages said lever member is a part of said arc chute.

15. An interlock means as defined in claim 9 in which said lever member is pivotally connected contiguous one end thereof to said interlock member.

16. An interlock means as defined in claim 15 in which said lever member includes a U-shaped end portion opposite said one end, said U-shaped end portion being telescopically engageable with a wall portion of the insulating base of said circuit maker and breaker.

17. In combination, a circuit maker and breaker including a stationary contact and a movable contact movable into engagement with said stationary contact, an arc chute adapted to be positioned on said circuit maker and breaker and defining an arcing compartment which embraces said stationary contact and said movable contact, an interlock means comprising an interlock member mounted for pivotal movement on said circuit maker and breaker, said interlock member including a plug element carried thereby, said interlock means additionally comprising a lever member engaging said interlock member and located in the path of positioning movement of said arc chute, whereby when said arc chute is properly positioned on said circuit maker and breaker means movable with said arc chute engages said lever member to pivotally move said interlock member to a position in which said plug element is raised against the force of gravity out of blocking relation to movement of said movable contact into engagement with said stationary contact, said interlock member falling by gravity into said blocking relation when said arc chute is improperly positioned on or is entirely absent from said circuit maker and breaker.

18. The combination defined in claim 17 in which said circuit maker and breaker includes a ferromagnetic yoke, an electrical winding operatively associated with said yoke whereby said yoke is magnetized when said winding is energized, a ferromagnetic armature member mounted for movement into engagement with said yoke when said yoke is magnetized, said movable contact being carried by said armature member, said plug element of said interlock member falling by gravity into blocking relation to movement of said armature member into engagement with said yoke member when said arc chute is improperly positioned on or is entirely absent from said circuit maker and breaker, whereby to prevent closing movement of said movable contact into engagement with said fixed contact.

19. The combination defined in claim 17 in which said means movable with said arc chute which engages said lever member is a part of said arc chute.

20. The combination defined in claim 17 in which said lever member is pivotally connected contiguous one end thereof to said interlock member.

21. The combination defined in claim 10 in which said lever member includes a U-shaped end portion opposite said one end, said U-shaped end portion being telescopically engageable with a wall portion of the insulating base of said circuit maker and breaker.

22. An interlock means for use with a circuit maker and breaker, in which said circuit maker and breaker includes a stationary contact and a movable contact movable into engagement with said stationary contact, and in which an arc chute is adapted to be positioned on said circuit maker and breaker and defines an arcing compartment which embraces said stationary contact and said movaable contact, said interlock means comprising an interlock member mounted for pivotal movement on said circuit maker and breaker, said interlock member including a plug element carried thereby, said interlock means additionally comprising a lever member engaging said interlock member and located in the path of positioning movemenmt of said arc chute, whereby when said arc chute is properly positioned on said circuit maker and breaker means movable with said arc chute engages said lever member to pivotally move said interlock member to a position in which said plug element is raised against the force of gravity out of blocking relation to movement of said movable contact into engagement with said stationary contact, said interlock member falling by gravity into said blocking relation when said arc chute is improperly positioned on or is entirely absent from said circuit maker and breaker.

23. An interlock means as defined in claim 22 in which said circuit maker and breaker includes a ferromagnetic yoke, an electrical winding operatively associated with said yoke whereby said yoke is magnetized when said winding is energized, a ferromagnetic armature member mounted for movement into engagement with said yoke when said yoke is magnetized, said movable contact being carried by said armature member, said plug element of said interlock member falling by gravity into blocking relation to movement of said armature member into engagement with said yoke member when said arc chute is improperly positioned on or is entirely absent from said circuit maker and breaker whereby to prevent closing movement of said movable contact into engagement with said fixed contact.

24. An interlock means as defined in claim 22 in which said means movable with said arc chute which engages said lever member is a part of said arc chute.

25. An interlock means as defined in claim 22 in which said lever member is pivotally connected contiguous one end thereof to said interlock member.

26. An interlock means as defined in claim 25 in which said lever member includes a U-shaped end portion opposite said one end, said U-shaped end portion being telescopically engageable with a wall portion of the insulating base of said circuit maker and breaker.

* * * * *

UNITED STATES PATENT OFFICE

CERTIFICATE OF CORRECTION

Patent No. 3,992,599 Dated November 16, 1976

Inventor(s) Edward A. Halbach

It is certified that error appears in the above-identified patent and that said Letters Patent are hereby corrected as shown below:

Column 12, line 1, "10" should read --- 20 --- .

Signed and Sealed this

*Thirteenth* Day of *September 1977*

[SEAL]

*Attest:*

RUTH C. MASON
*Attesting Officer*

LUTRELLE F. PARKER
*Acting Commissioner of Patents and Trademarks*